US006131213A

United States Patent [19]

Sarff

[11] Patent Number: 6,131,213

[45] Date of Patent: Oct. 17, 2000

[54] WALL MOUNTED FOLDING GRAB BAR

[76] Inventor: Lawrence L. Sarff, P.O. Box 984, Veradale, Wash. 99037

[21] Appl. No.: 09/432,401

[22] Filed: Nov. 2, 1999

[51] Int. Cl.[7] ..... A47K 3/024

[52] U.S. Cl. ..... 4/576.1; 4/611; 211/105.1; 248/251

[58] Field of Search ..... 4/576.1, 577.1, 4/604, 611; 16/116.1, 445; 211/105.1; 248/251, 274.1; 182/89, 91

[56] References Cited

U.S. PATENT DOCUMENTS

| | | | |
|---|---|---|---|
| 2,059,171 | 10/1936 | Harris | 4/185 |
| 2,465,814 | 3/1949 | O'Brien | 4/185 |
| 3,028,604 | 4/1962 | Warner | 4/185 |
| 3,228,038 | 1/1966 | Augustine | 4/185 |
| 3,275,283 | 9/1966 | Rauch | 4/611 X |
| 4,563,783 | 1/1986 | Jenkins | 4/576 |
| 4,908,906 | 3/1990 | Hanna | 4/576.1 X |
| 5,050,252 | 9/1991 | Cuttriss | 4/576.1 |
| 5,306,217 | 4/1994 | Bracone | 482/55 |
| 5,659,904 | 8/1997 | Doczy et al. | 4/577.1 |

*Primary Examiner*—Charles E. Phillips
*Attorney, Agent, or Firm*—Keith S. Bergman

[57] ABSTRACT

A wall supported grab bar structure provides two similar spacedly opposed L-shaped brackets interconnected by a fixed bar extending therebetween and carrying a U-shaped foldable bar to pivot relative thereto. Each bracket carries screw fasteners for mounting the brackets on structural elements of a supporting wall. The foldable bar pivots from a relaxed position parallel to a wall supporting a use to the brackets position perpendicular to the supporting wall. Spring leaf fasteners carried in the outer end portion of each leg of the foldable bar each provide a release pin and a spacedly distant fastener pin to releaseably interfit in a hole defined in the adjacent L-shaped bracket to releasably maintain the foldable bar in an extended operative position. Each fastener pin is releaseable responsive to motion of the spacedly distant release pins and both release pins must be simultaneously operated to release the foldable bar from a use portion.

5 Claims, 2 Drawing Sheets

WALL MOUNTED FOLDING GRAB BAR

BACKGROUND OF INVENTION

RELATED APPLICATIONS

There are no applications related hereto now or heretofore filed in this or any foreign county.

FIELD OF INVENTION

This instant invention relates general to wall mounted hand grips and more particularly to a hand grip having a first fixedly mounted gripping bar and a second pivotally mounted gripping bar.

BACKGROUND

Grab bars of various sorts have long been a necessity to allow infirm and disabled persons to function as independently as reasonably possible in their normal activities. By reason of this such devices have had a long history and many diverse grab bars have become known for general and specific purposes, but the essential features of such devices have remained quite similar to their progenitors.

User's safety is and always has been of prime design concern with grab bars, as any person using such devices generally has a disabling infirmity or impairment of some sort or a grab bar would not be used. Such impairment commonly may, and often does, affect the user's overall functioning other than merely kinesthesia. By reason of this safety features for grab bars have required even higher standards than for similar devices for use by users that are not disabled or infirm. This has been especially true in institutional care facilities where often the persons using grab bars are more numerous and commonly more disabled and infirm than are users in home and residential environs.

Largely because of safety considerations, grab bars must be of relatively simple construction and responsively most historical grab bars have had no moving parts, and especially no grab bar per se that moves. Grab bars often are used in bathrooms, washing facilities and other places where space is limited by reason of generally smaller enclosed areas that house numerous fixtures and structures which are usually provided in such areas. One or more grab bars that may be required in such an environment merely add to the general crowding and access problems and this is increasingly so with immovable grab bars. The instant grab bar structure seeks to resolve or at least lessen these problems by providing a device that has a first fixed grab bar more closely adjacent to a supporting structural wall than a second pivotally mounted, outwardly extending U-shaped grab bar, but yet complies with the strict rigid and safety standards that must be met for such devices while maintaining economic viability.

These results are accomplished primarily by the relatively simple construction of the instant grab bar structure and the particular method of mounting and positionally maintaining the second U-shaped grab bar in an outwardly extending operative position. I provide a realeaseable fastening structure in the outer portion of a channel defined in each leg of the U-shaped foldable bar in the area of its adjacency to one pair of L-shaped brackets supporting the bar on a structural wall. The fastening structure is of a leaf spring type with a first fastening pin extendable through the adjacent foldable bar leg and into a fastening hole defined in the adjacent bracket. The fastening pin is so configured and positioned that it can not be released by direct manual manipulation, but rather only by moving a second release pin spacedly distant from the adjacent bracket. Both of the support and release pins are carried in areas of the grab bar structure that are not usually or easily accidentally contacted by a user, so that their operation has a high probability of being deliberate, My invention lies not in any one of its individual features, but rather in the synergistic combination of all of its structures that necessarily give rise to the functions flowing therefrom as herein specified, illustrated and claimed.

SUMMARY OF INVENTION

My folding grab bar provides a compound structure having two similar L-shaped brackets that are mirror images of each other spacedly interconnected by a first inner fixedly grab bar and pivotally carrying a second U-shaped foldable grab bar movable from a stored position adjacent a supporting wall to a releaseably maintainable operative position outwardly of the first grab bar and perpendicular to the supporting wall. The L-shaped brackets are structurally interconnected with frame elements of the supporting wall for supportative positional maintenance. The foldable grab bar is releasably maintained in an extended position by leaf spring fasteners carried in the end portion of each leg of the U-shaped bar. Each fastener carries a first fastening pin to extend a fastening hole defined in the associated L-shaped bracket and a second release pin spacedly distant from the associated L-shaped bracket to release the interconnection of the fastening pin from the bracket.

In providing such a device, it is:

A principal object to provide a wall mounted grab bar structure having a first fixed inner bar and second foldable outer bar releasably movable from an outwardly extending use position to an inward stored position adjacent a supporting wall.

A further object is to provide such a grab bar structure that has leaf spring fasteners in the end portion of each leg of the foldable bar, to carry a fastening pin to interconnect in a hole in the adjacent L-shaped bracket for releasable positional maintenance of the foldable bar and a second release pin in a position spacedly distant from the L-shaped bracket to release the fastening pin.

A still further object is to provide such grab bar that has security and safety features required for institutional use and is formed from materials appropriate to that use, but yet with economic viability.

A still further object is to provide such a grab bar structure that is of new and novel design, of rugged and durable nature, of simple and economic manufacture and one otherwise well adapted for the uses and purposes for which it is intended.

Other and further objects of my invention will appear from the following specification and accompanying drawings which form a part hereof. In carrying out the objects of my inventions however, it is to be remembered that its accidental features are susceptible of change in design and structural arrangement with only one preferred and practical embodiment of the best known mode being illustrated in the accompanying drawings and specified as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

Figure 1:
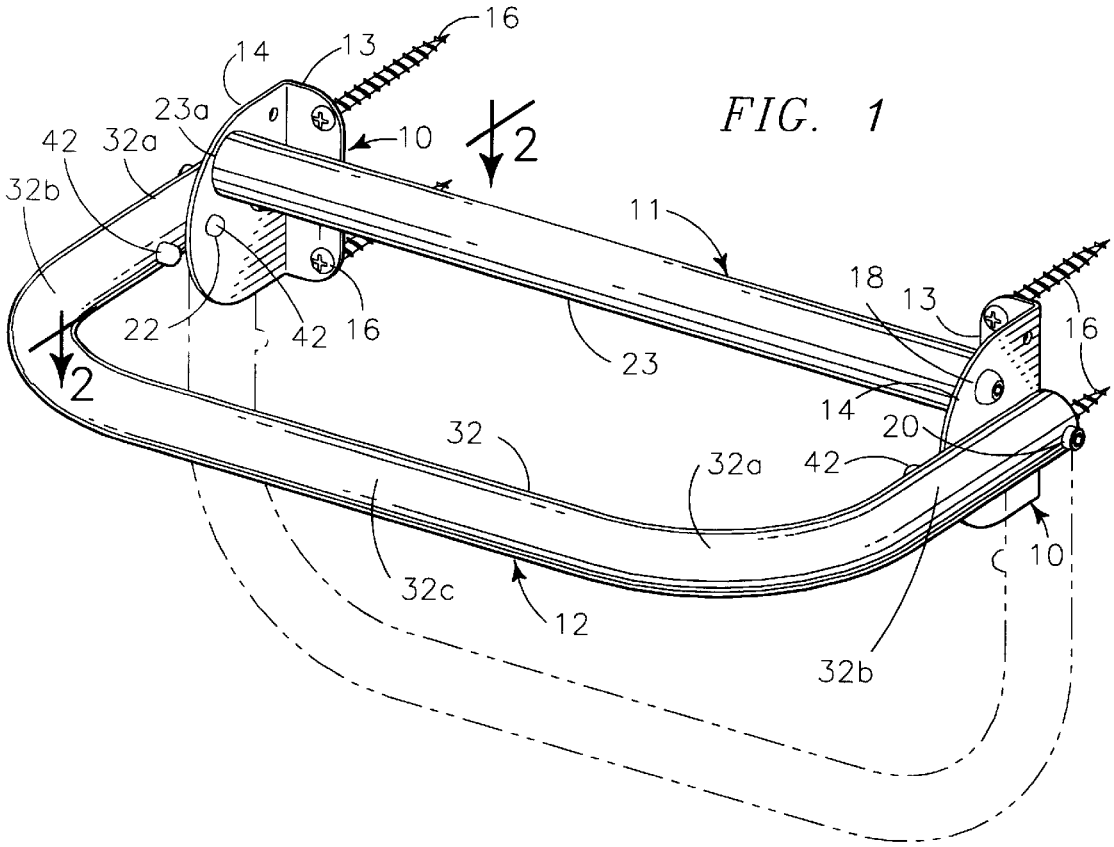
FIG. 1 is an isometric view of my folding grab bar showing various of its parts, their configuration and relationship, with the stored position of the foldable bar illustrated in broken outline.

My folding grab bar provides two similar L-shaped mounting brackets 10 that are interconnected in spaced adjacency by fixed bar 11, extending in structural interconnection between the adjacent surfaces of the mounting brackets, and pivotally carry U-shaped foldable bar 12 interconnected between the outer surfaces of the mounting brackets for selective positioning.

Mounting brackets 10 are L-shaped structures each formed by planar wall arm 13 structurally interconnected with perpendicularly extending bar fastening arm 14. Each bracket is a mirror image of the other and dimensioned to accommodate the grab bar elements associated therewith, but without superfluous size to cause unnecessary obstruction. The vertical extension of the brackets is greater by about one-third than the perpendicular horizontal dimension extending outwardly from a supporting wall.

The wall arm 13 generally defines a rectilinear periphery with vertical length approximately one third greater than the horizontal width. The fastening arm 14 defines a somewhat horizontally elongated semicircular peripheral configuration in the preferred form illustrated, though neither the configuration nor dimensioning of the bracket elements 13, 14 are intended to be, nor are, limiting.

The wall arm 13 of each bracket defines three vertically spaced fastener holes 15, inwardly adjacent each vertical end and in a medial position therebetween, to receive elongate fasteners 16, in the form illustration screws, to structurally interconnect the brackets with a frame element of a supporting structural wall such as a vertical stud, horizontal lintel or specially placed support member.

The bar fastening arm 14 of each bracket 10 defines fastener hole 17 in its upper portion spacedly outwardly from a supporting wall to receive threaded fastener 18, in the instance illustrated a bolt, to structurally interconnect fixed bar 11 between the brackets. Foldable bar fastener hole 19 is defined in the vertically medial inner portion of the fastening arm to receive foldable bar fastener 20 that pivotally interconnects the inner end portions of foldable bars 12 with the adjacent brackets. The foldable bar fastener 20, in the instant illustrated in FIG. 2, comprises an elongate bolt having a cylindrical medial portion 20*a* to journal the foldable bar and threaded inner end portion 20*b* for releaseably fastening the bolt in the fastener hole 19 of the fastening arm by means of nut 21 threadedly engaged thereon on the inner surface of the fastening arm. Fastening pin hole 22 is defined in the vertically medial outer portion of the fastening arm, preferably with its center on a line through the center of fastener hole 19 and perpendicular to the plane of wall arm 13. The fastening pin hole 22 is configured to slidably receive a fastening pin carried by fastening structure in the foldable bar 12 in a releaseably fastenable fit.

Figure 3:
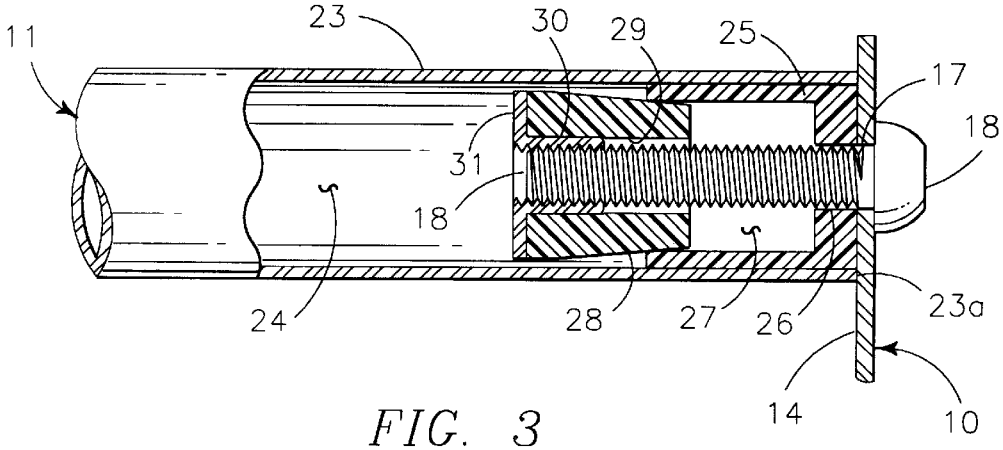
FIG. 3 is a somewhat enlarged partial cut away view through the right end portion of the fixed bar and adjacent bracket of FIG. 1 to show details of the interconnection of these elements.

Fixed bar 11 provides elongate cylindrical tube 23 defining medial channel 24. The tube 23 is of such length as to provide a hand gripping surface of desired extent, normally with a length of 12 to 18 inches and a diameter of approximately 1.25 inches to provide effective and safe gripping by an average sized hand. The bar provides planar ends 23*a* to fit in adjacency on the opposed inner surfaces of brackets 10 and about the fastener holes 17 defined therein. Each end of tube 23 carries cylindrical end plug 25 defining smaller outer fastener channel 26 and larger inner wedge channel 27 to aid fastening of the tube between the bar fastening arms 14 of the brackets 10. Each channel 27 carries outwardly tapering frustro-conical fastening wedge 28 defining inner fastener channel 29 which carries fastening nut 30, with axially inward and radially outwardly extending rim 31 extending over the rearward portion of the wedge 28, to threaded engage fastener 18. With this structure when assembled as shown in FIG. 3, as the fastener 18 is tightened with it head outwardly adjacent the fastening arm of bracket 10, the wedge 28 will be moved into the wedge channel 27 to provide a releaseably fastenable interconnection between each end of the fixed bar 11 and the adjacent bar fastening arms 14 of bracket 10.

Foldable bar 12 provides U-shaped cylindrical tube 32 formed by parallel lateral legs 32*a* interconnected by medial curved portions 32*b* to medial body portion 32*c* and defining internal channel 33. The cylindrical tube 32 is normally, but not necessarily, of the same diametrical size as fixed bar tube 23 and is dimensioned so that the adjacent laterally inner surfaces of inner legs 32*a* fit immediately outwardly adjacent the laterally outer surfaces of fastening arms 14 of the brackets to be pivotally movable thereover.

Figure 2:
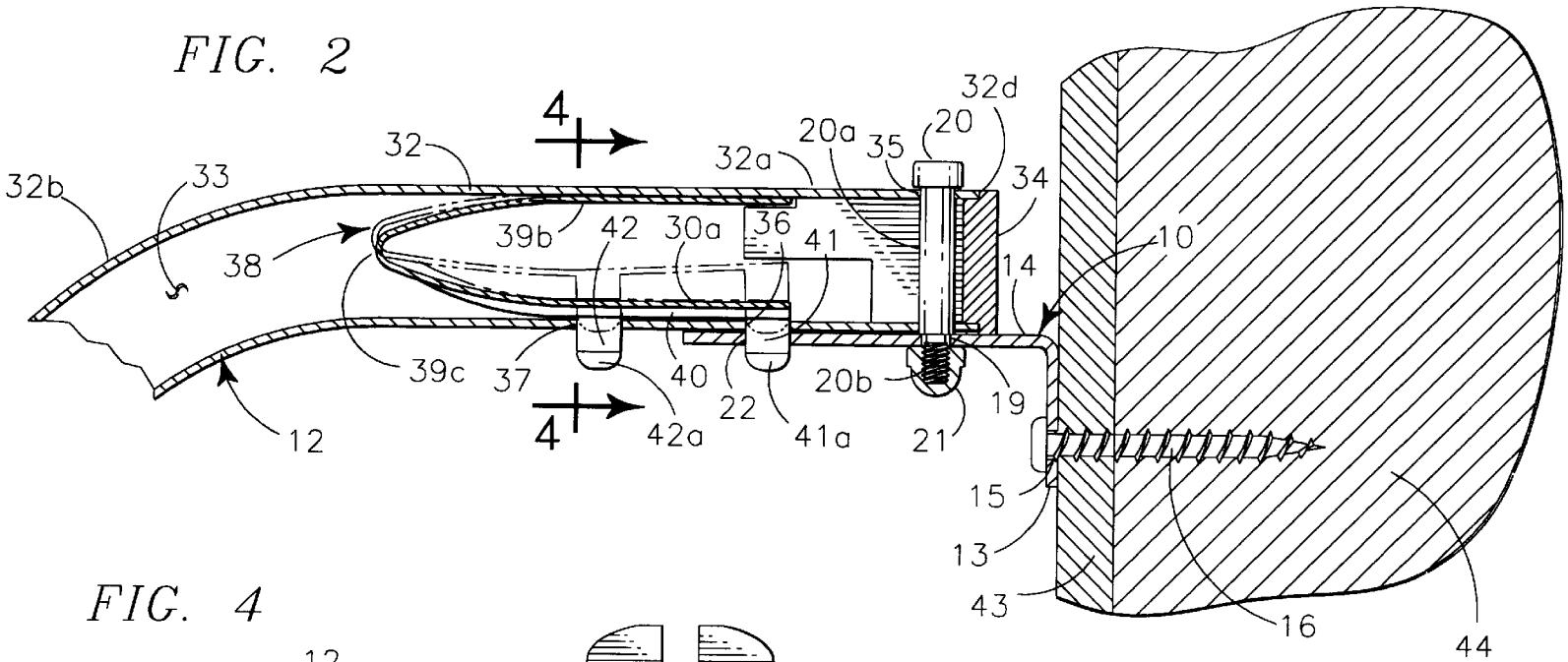
FIG. 2 is a partial horizontal cross sectional view through the left end portion of the foldable bar and the adjacent bracket of FIG. 1 to show details of the interconnection of these structures.
Figure 5:
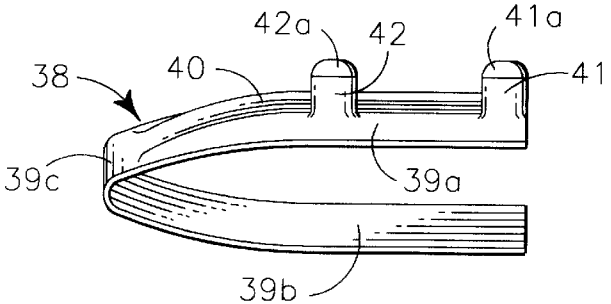
FIG. 5 is an isometric view of the spring fastener structure to show its configuration and details.

The inner portion to fastenably fit within channel 33 defined by the tube. The inner end portions 32*a* of the inner legs each define paired opposed fastener holes 35 to pivotally journal body portion 20*a* of fastener 20. The fastener holes 35 are so positioned that the ends 32*d* of the inner legs 32*a* will be spacedly outwardly distant from the wall supporting wall arms 13 of each bracket 10 to allow the pivotal motion of the end portion of the U-shaped bar relative to a wall supporting the brackets 10 as illustrated in FIG. 2. The inner legs 32*a* spacedly outwardly of fastener holes 35 define fastener pin holes 36 in the tube surface adjacent the associated bracket 10. The fastener pin holes 36 have an axis parallel to the axis of fastener hole 35 that extends through the elongate axis of tube 32 at a position to allow the fastener pin hole to move into coincidence with fastener hole 22 defined in fastening arm 14 of the adjacent bracket when the foldable bar 12 is pivotally moved to a position perpendicular to wall arm 13. Release pin hole 37 is defined in the bracket facing surface of inner leg 32*a* spacedly outwardly from fastener pin hole 36 and spacedly outwardly from the outermost portion of bar fastening arm 14 of the adjacent bracket 10. The release pin hole 37 preferably has an axis passing through the elongate axis of U-shaped tube 32 and extending parallel to the axis of fastener pin hole 36.

Figure 6:
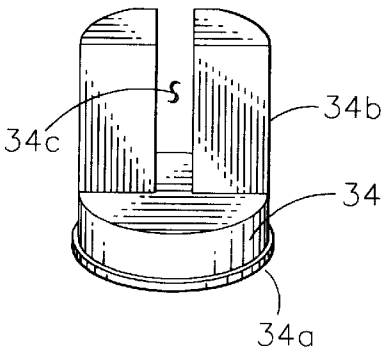
FIG. 6 is an isometric view of the isolated end plug of the U-shaped var to show its configuration and structure.
Figure 4:
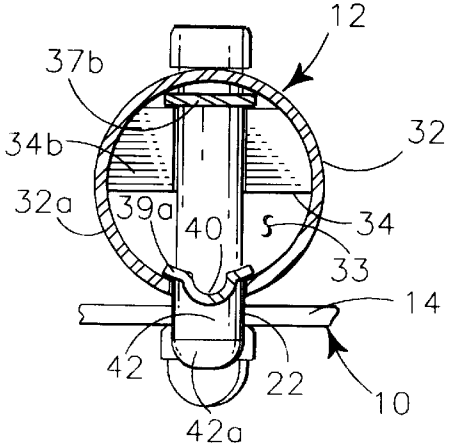
FIG. 4 is a vertical cross sectional view through the end portion of the inner leg of the foldable bar, taken on the line 4—4 on FIG. 2 in the direction indicated by the arrows thereon, to show details of the fastening structure.

The inner ends of inner legs 32*a* carry end seen especially in FIG. 6, caps 34, having an inner rim portion 32*a* of the same external diameter as tube 32 and a smaller outer portion 34*b* to fastenably fit within channels 33 defined by the tube. The outer portion 34*b* defines horizontal slot 34*c* to allow the outer portion 34*b* to extend outwardly in channel 33 past fastener 20 and to a point adjacent the fastening pin hole 36. A part 34*d* of the center portion 34*a* facing the fastening pin hole 36 is removed to allow the part of the outer end portion 34*c* to serve as a stop to prevent excessive radially inward motion of either a release pin or a fastening pin from the holes in the foldable bar carrying them without otherwise interfering with the motion of either pin.

Fastening structure 38 is carried in the inner portion of channel 33 defined in inner leg 32*a* of the foldable bar. The fastening structure 38 provides elongate leaf spring 39 having fastener arm 39*a* and spring arm 39*b* interconnected by U-shaped medial body portion 39*c*, all configured so that when the fastening structure is relaxed, the distance between the ends of the fastening arm and spring arm is greater than the diameter of channel 33 defined in tube 32, to bias both arms of the leaf spring to a radially outward position away from each other when the leaf spring is contained in channel 33. The fastening arm 39*a* preferably is formed with a medial ridge or protuberance 40 to provide somewhat of a beam-like effect that creates greater stiffness and rigidity to prevent or lessen bending of the fastening arm in an elongate direction. One leaf spring 39 is positioned in the channel 33 of each inner leg 32*a* with each fastening arm 39*a* facing inwardly towards the opposed fastening arm as illustrated in FIG. 2.

Fastening arm 39*a* of each leaf spring carries fastening pin 41 on its outer surface to extend outwardly a spaced distance therefrom. The fastening pin 41 preferably has rounded head 41*a* in its outermost portion to aid passage into an associated fastening hole and is sized and configured to fastenably fit within fastening pin hole 36 defined in inner leg 32*a* of the foldable bar and fastening pin hole 22 defined in fastening arm 14 of bracket 10. The axis of fastening pin 41 is substantially parallel to the axis of fastener 20, which pivotally mounts the foldable arm 12 on bracket 10. Release pin 42, preferably having rounded head 42*a* and a configuration similar to fastening pin 41, is carried on the outer surface of fastening arm 39*a* of the fastener 20 to extend outwardly therefrom at a point spacedly outwardly distant from fastening pin 41. The distance between the fastening pin and the release pin 42 is such as to position the release pin outwardly of the outermost extension of the fastening arm 14 of bracket 10 when the fastening pin 41 is carried in fastening pin hole 22 defined in the fastening arm, as illustrated in FIG. 2. The radially outward extension of the release pin 42 must be at least as great as that of fastening pin 41 to release the fastening pin, but that extension preferably is not substantially more than that of the radially outwardly extension of the fastening pin.

A grab bar structure, formed in accordance with the foregoing specification, is fastened in predetermined position to a supporting structure such as vertical wall 43 by inserting fasteners 16 in holes 15 defined in wall arms 13 of brackets 10 and establishing the fasteners in fastenable interconnection with a structural frame element 44 of wall 43.

The fixed bar, foldable bar and L-shaped brackets 10 are all formed of metal for appropriate strength, rigidity and durability, preferably stainless steel or chrome plated steel This material also provides surfaces that may be readily and conveniently cleaned and the material may be sterilized by ordinary methods commonly used in institutional settings. The leaf spring element 39 is formed of spring steel to provide appropriate elasticity. The internal fastening elements interconnecting fixed bar 11 to brackets 10 are formed of metal or more resiliently deformable material such as a harder more dense polymeric plastic, though in the instance illustrated nut 30 is formed of metal for strength and durability.

Having described my grab bar structure, its operation may be understood.

A grab bar structure formed according to the foregoing specification is attached to a structural wall in predetermined position for use. The grab bar structure normally is attached to a vertical supporting wall with the fixed and foldable bars in horizontal orientation as the most desirable positioning, though the grab bar structure may be attached with the bars extending in angulated orientation. An angulated orientation however may be less safe in use than vertical or horizontal orientation of the structure. The grab bar structure is interconnected to the supporting wall by fasteners 16 extending through holes therefore defined in the wall arms 13 of brackets 10 and into supportative interconnection in the supporting wall. The positioning of the grab bar structure and supporting wall construction should be such that the fasteners 16 extend into structural members of the supporting wall, commonly either existing vertical studs, horizontal lintels or other structural elements placed specifically for fastening of the grab bar structure. It usually is convenient to have the wall arms of the brackets spaced apart to accommodate normal vertical stud spacing common in the construction industry, generally sixteen inches for light frame construction. The fasteners 16 should be of such size as will accommodate loads to be placed upon the grab bar structure with an appropriate safety factor of at least fifty percent.

The operation of the grab bar structure is the same regardless of its placement orientation and therefore for convenience the operation is described for the horizontal orientation illustrated in FIG. 1.

The fixed bar 11 is established for use upon installation of the grab bar structure on a supporting wall. When the foldable bar 12 is in a relaxed vertically depending position, as illustrated in phantom outline in FIG. 1, the bar is extended to its horizontal use position by manually pivoting it upwardly until fastening pins 41 by reason of their move into associated fastening pin holes 22 defined in the bar fastening arms 14 of each bracket 10. It is to be noted that when the foldable bar is in its relaxed position each fastening pin 41 will be maintained with the outer portion of the fastening pin head 41*a* immediately adjacent the laterally outer surface of the fastening arm 14 by reason of the radially outward bias created by leaf spring 39, so that as the fastening pin 41 moves over fastening pin hole 22 defined in the adjacent bracket, the fastening pin will move outwardly and into fastenable interconnection in the hole. As this occurs, the foldable bar 12 is in its horizontal operative position and will be maintained in this position as illustrated in FIG. 1 unless and until released.

To move the foldable bar from its operative position to its relaxed stored position, both release pins 42 are simultaneously manually moved radially inwardly so that no portion of either of those pins projects outwardly beyond the outer surface of the inner leg 32*a* of the foldable bar. This causes fastening arm 39*a* of the leaf springs to move radially inwardly in channel 33 against their bias to move the associated fastening pins 41 inwardly and out of fastening pin holes 22 defined in the fastening arms 14 of the associated brackets to release the fastenable interconnection of the fastening pin 41 with that bracket. While maintaining the release pins in this position, the foldable bar 12 is manually pivoted downwardly to its relaxed stored position and the fastener pin 41 will be maintained under some bias with its outermost portion 41*a* immediately adjacent the outer surface of the associated bracket fastening arm 14.

In performing the release operation of the foldable bar 12 it is to be noted that both release pins 42 must be simultaneously moved radially inwardly into the foldable bar channel 33 at the same time and the foldable bar must be pivoted downwardly through a slight angle to cause release of the foldable bar from its fastened position. This operation requires some degree of willful dexterity, especially in view of the positioning of the release pins, that has a high probability of preventing accidental release of the horizontally positioned foldable bar by reason of accidental happenings caused either by third parties or by a user. If an accidental dislodgment of the foldable bar should occur, the fixed bar 11 still remains in operative position for support of the user.

It is further to be noted that though the foldable bar 12 requires deliberate willful action for movement to a relaxed position, that bar is established in a releaseably fastened, horizontally extending position merely by pivoting the bar to that position, as the fastener structure will operate automatically by reason of the outward bias on fastening pins 41 to cause those pins to enter the fastening pin holes 22 when the fastening pins are moved in their arcuate courses over the fastening pin holes.

The foregoing description of my grab bar structure is necessarily of a detailed nature so that a specific embodiment of it might be set forth as required, but it is to be understood that various modifications of detail rearrangement and multiplication of parts might be resorted to without departing from its spirit, essence or scope.

Having thusly described my invention, what I desire to protect by Letters Patent, and

What I claim is:

1. A grab bar structure for mounting on a structural wall, comprising in combination:

two spacedly opposed L-shaped brackets each having coplanar wall arms interconnecting perpendicularly extending bar fastening arms, said wall arms having means for structural interconnection with a supporting wall and said bar fastening arms extending in parallel orientation from the wall arms and each bar fastening arm defining a fastener pin hole;

an elongate fixed bar having means for structural interconnection between the bar fastening arms of the L-shaped brackets spacedly distant from the wall arms; and a U-shaped foldable bar having a medial body interconnecting spaced parallel inner legs pivotally carried by the bar fastening arms of the L-shaped brackets with the medial body extending spacedly distant from the L-shaped brackets, said U-shaped foldable bar having:

a medial channel defined in each inner leg, a fastening pin hole defined in each inner leg to communicate from the medial channel through the inner leg and pivot into coincidence with the fastener pin hole defined in the bar fastening arm of the adjacent L-shaped brackets, a release pin hole defined in the each inner leg spacedly outwardly of the bar fastening arm of the adjacent L-shaped bracket, to communicate from the medial channel through the inner leg, and fastener means carried in the medial channel defined in each inner leg, each fastening means having a fastening pin projecting radially outwardly through the fastening pin hole for releaseably fastenable positioning in the fastening pin hole defined in the foldable bar arm of the adjacent L-shaped bracket, a release pin projecting radially outwardly through the release pin hole to move the fastener pin from interconnection in the fastening pin hole in the L-shaped bracket responsive to release pin motion, and means to bias the fastening pin and the release pin into a radially outward position.

2. The grab bar structure of claim 1, wherein the fastener means carried by each inner leg of the foldable bar is further characterized by:

an elongate U-shaped leaf spring having a fastening arm and an opposed spring arm carried in each channel defined in each inner leg of the foldable bar to bias the fastening arm radially outwardly in the channel, the fastening pin carried by the fastening arm to extend radially outwardly therefrom, and the release pin carried by the fastening arm outwardly of the outer extension of the associated L-shaped bracket, and having a radially outward projection at least as great as the radially outward projection of the fastening pin to cause release of the fastening pin from the fastening pin hole defined in the adjacent bracket fastening arm responsive to radially inward motion of the release pin.

3. The grab bar structure of claim 2 further characterized by:

the fastening arm of the leaf spring formed with an elongate medial ridge to provide stiffness and rigidity.

4. The grab bar structure of claim 2 further characterized by:

end caps carried in the end portions of the medial channels defined in each inner leg of the U-shaped foldable bar, each end cap having an axially inwardly extending portion to limit the radially inward extension of the fastening arm of the U-shaped leaf spring to prevent radially inward motion of the fastening arm sufficient to remove the fastening pin from the fastening pin hole defined in the inner leg.

5. The grab bar structure of claim 1 wherein the means for structural interconnection of the fixed bar to the adjacent L-shaped brackets comprise:

a channel defined at least in each end portion of the fixed bar;

an end plug carried in each channel in each end portion of the fixed bar, each end plug defining a smaller medial fastening channel in its outer portion communicating with a larger cylindrical wedge channel in its inner portion;

a frustro-conical wedge carried with its smaller end portion in the outer portion of the wedge channel for fastenable engagement therein and having a medial threaded fastener channel;

a threaded fastener extending through the bar fastening arm of the adjacent L-shaped bracket and into threaded engagement within the threaded fastener channel of the frustro-conical wedge to fasten the wedge in the wedge channel defined by the end plug.

* * * * *